United States Patent [19]

Novacek

[11] Patent Number: 4,537,664

[45] Date of Patent: Aug. 27, 1985

[54] METHOD FOR CONTINUOUSLY MONITORING OXIDE THICKNESS ON MOVING ALUMINUM FOIL

[75] Inventor: William G. Novacek, Clinton, Tenn.

[73] Assignee: Sprague Electric Company, North Adams, Mass.

[21] Appl. No.: 597,300

[22] Filed: Apr. 6, 1984

[51] Int. Cl.[3] ..... C25D 11/04

[52] U.S. Cl. ..... 204/28; 204/1 T; 204/58; 324/61 R

[58] Field of Search ..... 204/1 T, 28, 56 R, 58; 324/60 C, 61 R

[56] References Cited

U.S. PATENT DOCUMENTS

| | | | |
|---|---|---|---|
| 3,632,486 | 1/1972 | Herrmann et al. | 204/33 |
| 3,962,048 | 6/1976 | Gilbert et al. | 204/28 |
| 3,979,666 | 9/1976 | MacLean et al. | 324/61 R |
| 3,988,215 | 10/1976 | Scherr, III | 204/28 |
| 4,014,758 | 3/1977 | Kawai et al. | 204/28 |
| 4,226,680 | 10/1980 | Cooke et al. | 204/28 |
| 4,370,210 | 1/1983 | Yoshihara | 204/140 |

*Primary Examiner*—Andrew H. Metz
*Assistant Examiner*—William T. Leader

[57] ABSTRACT

Either after or during the process of forming aluminum foil for use in making electrolytic capacitors, the formed oxide foil is drawn through two separate electrolytes wherein two electrodes are immersed respectively. An AC voltage source is connected between the two electrodes. The resulting reactive current is a direct measure of the potential capacitance per unit foil area that can be obtained in capacitor manufacturing and is also an indirect measure of the oxide film thickness.

7 Claims, 2 Drawing Figures

METHOD FOR CONTINUOUSLY MONITORING OXIDE THICKNESS ON MOVING ALUMINUM FOIL

BACKGROUND OF THE INVENTION

This invention relates to a method for monitoring the thickness of aluminum oxide film formed on a moving aluminum foil which foil is intended for use in an electrolytic capacitor. More particularly, the invention is for continuously monitoring the potential electrical capacity of the formed foil as it exits an oxide formation machine. The term "formed foil" and variations thereof are used herein to mean anodizing, as is common practice in the capacitor art.

A formed foil is conventionally made by drawing a bare-aluminum foil through a liquid electrolyte and applying a voltage between the aluminum and the electrolyte as is described more fully by Gilbert et al in U.S. Pat. No. 3,962,048 issued June 8, 1976 and assigned to the same assignee as is the present invention.

The aluminum foil to be formed has normally been etched so as to increase the effective surface area per square area of the foil and therefore to increase the electrical capacity that can be obtained at each square of aluminum for a given thickness of aluminum oxide film. That oxide is to become the dielectric of an electrolytic capacitor. It should also be noted that in general, the electrical capacity is inversely related to the thickness of the oxide film.

It is well known that producing a uniform etch and a uniformly thick oxide film lead to tighter tolerance and/or lower cost capacitors. This is further elaborated by Arora et al in U.S. Pat. No. 4,279,714 issued July 21, 1981 and assigned to the above-said same assignee.

At the present time it is customary to periodically cut out a sample piece of the formed aluminum film, to submerse the sample piece in a beaker of electrolyte, to apply an AC voltage between the aluminum and the electrolyte, and to determine the ratio of reactive AC current to the AC voltage, from which the electrical capacity of the sample can be determined. Besides being time consuming, this sampling method often provides less than enough information to enable the determination of just the right quantity of the formed foil that should be incorporated in a capacitor of a given capacity, owing to variations in oxide film thickness and etch ratio along the length of the foil. It is therefore an object of this invention to provide a continuous method for monitoring the potential capacity and thus a measure of the oxide thickness of a formed aluminum foil.

It is a further object of this invention to provide such a continuous monitoring method that will be effective at the point where the formed foil exits a continuous forming machine.

SUMMARY OF THE INVENTION

To continuously monitor the thickness of the oxide that is formed on an aluminum foil, such formed foil is drawn first through another but separate electrolyte. These two electrolytes may be of the same or of different compositions but are electrically isolated from each other. First and second electrodes are immersed in the one and another electrolytes, respectively. An AC voltage source is connected between the two electrodes causing a reactive current to flow through the electrolytes that each have a capacitive relationship with the aluminum foil via the oxide dielectric. The foil completes the circuit. Assuming that the voltage of the AC source is constant, the current is a direct measure of the capacity and thus an inverse measure of the thickness of the oxide film covering the foil.

This measure of oxide thickness is useful in segregating and characterizing long lengths of formed foil for which the profile of capacity along the foil may be recorded for use in a method for very accurately manufacturing capacitors of close tolerance and for which the oxide thickness measure is other wise useful to control the oxide thickness itself by adjustments in the formation process parameters e.g. speed of drawing or formationcurrent amplitude.

BRIEF DESCRIPTION OF THE DRAWING

With reference to FIG. 1 an etched and formed aluminum foil 10 is shown being drawn from left to right over idler rollers 12 so that it is first immersed in the liquid electrolyte 14 contained by tank 16, and is subsequently immersed in liquid electrolyte 18 contained by tank 20. The particular electrolyte employed here is one typically used in the electroforming of aluminum foil, namely an aqueous solution of aluminum dihydrogen phosphate having a resistivity of about 200 ohm-cm. First and second stainless steel electrodes 22 and 24 are also immersed in the electrolytes 14 and 18, respectively, and are spaced from the foil 10. A source 26 of AC voltage is electrically connected between the two electrodes 22 and 24. A current indicating device 28 is connected in series with the AC source 26 and a voltmeter 30 is connected across source 26.

Figure 1:
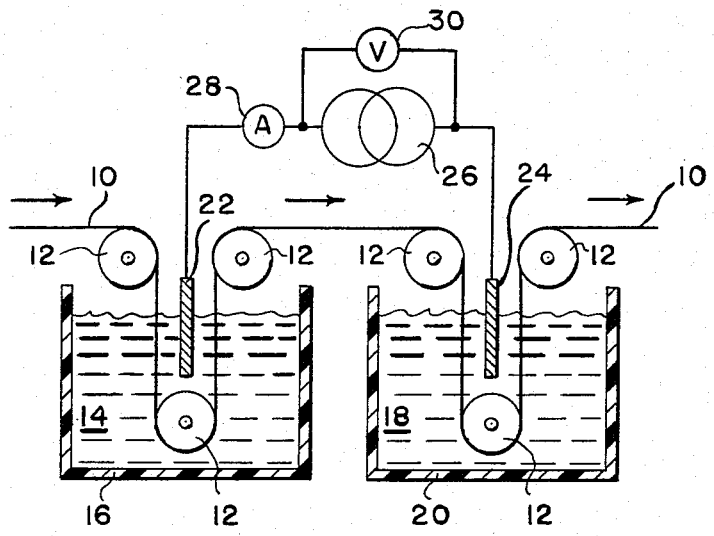
FIG. 1 shows schematically in side section, the apparatus employed in a preferred embodiment of the oxide thickness monitoring method of this invention.

As the formed foil 10 is drawn through the two consecutive electrolytes 14 and 18, an AC current flows between the electrodes 22 and 24 via (A) the capacitor made up of electrolyte 14, the aluminum oxide film as the dielectric and the foil 10; (B) the foil 10 and (C) the capacitor made up of foil 10, the aluminum oxide film as the dielectric and the electrolyte 18.

Each of these electrolyte capacitors, however, is effective as a capacitor only when the voltage at the foil 10 is positive relative to the voltage of the electrolyte 14 or 18. But when one of these electrolytic capacitors is reverse biased by more than about 1.3 volts, it conducts. Thus each electrolyte capacitor has an equivalent circuit consisting of an ideal capacitor paralled by a diode. Therefore, when the applied AC voltage between electrodes 22 and 24 is greater than about 10 volts, the current is limited by a capacitive reactance corresponding to the capacity of one of the ideal capacitors. But when less than 0.9 volts (r.m.s.) ($=0.707\times1.3$ volts) is applied across electrodes 22 and 24, the current is reduced by a factor of 2 corresponding to the reactance of the two ideal capacitors in series.

The AC voltage of source 26 has a frequency of about 1 Hz. This low frequency has the advantage that the capacitive reactance becomes larger at lower frequencies so that it is dominant over the series resistances in the circuit in determining the magnitude of the current flowing. Such series resistances include the current path through the electrolytes 14 and 18 and the resistance of the foil 10 from one tank 16 to the other 20. A measure of the capacitance per unit area of the foil 10 is therefore the ratio of the AC current to the AC voltage applied, and the thicker is the aluminum oxide film formed over foil 10, the lower becomes the capacity and the AC current. If the above-noted series resistance is not insignificant, then instead of merely monitoring the magnitude of the AC current, one may determine and selectively use only the magnitude of the reactive (leading) component of the AC current to obtain a more accurate measure of the current attributed to the formed foil 10.

Among the numerous well known methods for obtaining only the reactive current is a phase sensitive detector of the ring bridge, or ring demodulator, type. As a part of the indicating device 28, the ring demodulator will produce a DC voltage that is proportional to that portion of the current flow that is 90° leading the voltage source 26.

Ring demodulator phase detector is described in the text entitled *Introduction to Electronics* by D. M. Hutton, published in 1964 by Holt, Rinehart and Winston, New York. The reference leading voltage is readily obtained by a standard phase shift network.

Toward reducing the resistance of the circuit of the AC current to be monitored, there can advantagously be added additional electrodes positioned on the side of the foil opposite to ones shown in the Figures (e.g. 22 in FIG. 1). Such additional electrodes were omitted from the drawing for the sake of simplicity and clarity.

The use of two electrolyte tanks 14 and 18 and respective electrodes 22 and 24 in each makes it possible to take this measure of oxide thickness without making direct contact to the aluminum foil itself. Such a contact could be made to the start end of the roll of formed film at the spindle of the "take off" roll or alternatively at the lead end of the foil at the spindle of the "take up" roll. In this case only one electrolyte containing tank need be used. Such direct contacts may lead to much higher and more variable series resistances. The two-tank/two-electrode method of this invention overcomes all of these problems and is more accurate and reliable.

Figure 2:
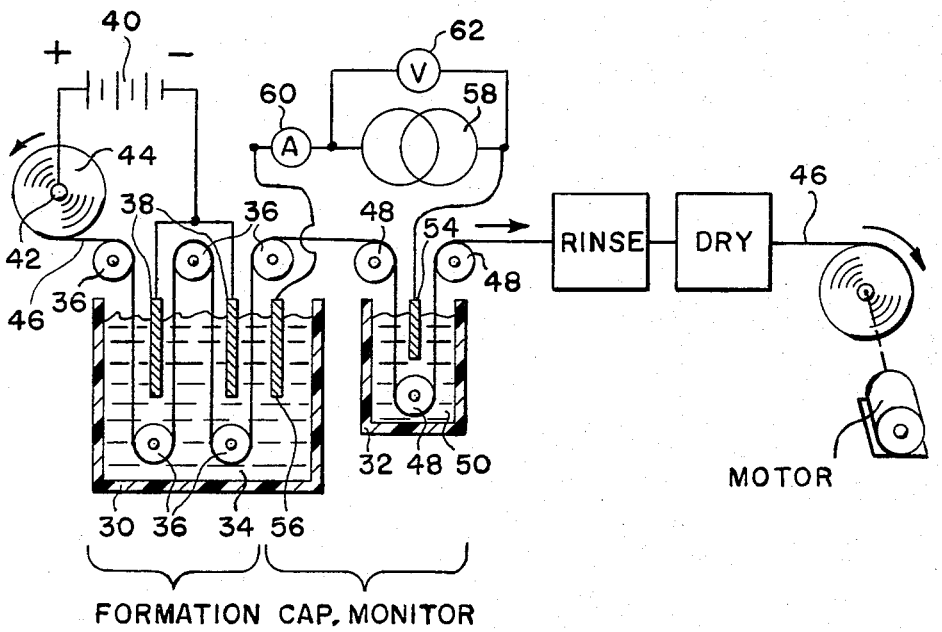
FIG. 2 shows schematically in side section the apparatus employed in another embodiment wherein the formation tank is shared in the two-tank monitoring method of this invention.

The foil 10 in FIG. 1 may be drawn directly from the machine (not shown) that formed it. In FIG. 2, the first 30 of two tanks is the formation machine tank itself and only one additional tank 32 is needed for continuously monitoring capacity. The formation machine is comprised of tank 30 containing formation-electrolyte 34, idler rollers 36 and electrodes 38. It is further comprised of a source of DC voltage 40 connected between the electrodes 38 and the metal spindle 42 on which there is mounted a roll 44 of unformed bare aluminum foil 46.

The aluminum foil 46 is threaded over rollers 36 in the formation machine and is subsequently threaded over idler rollers 48 in a second electrolyte 50 contained by the second tank 32. An electrode 54, immersed in the second electrolyte 50 and an auxillary electrode 56 immersed in the formation electrolyte 34 are powered by an AC voltage source 58. A series connected ammeter 60 and a voltmeter 62 connected across the voltage source 58 provide the continuous data needed to compute the impedance between the electrodes 54 and 56 at any instant of time.

It is anticipated that the electrical capacity in the formation tank 30 between electrode 56 and foil 46 will be orders of magnitude larger than that in second tank 32 between electrode 54 and foil 46 because of the much greater length of foil 46 in the formation tank 30. Therefore the capacity in the second tank will provide the dominant impedance to the current monitored by ammeter 60. In this case, the applied voltage must be less than 0.9 volts or meaningless readings will be obtained.

The source 40 of formation current in the formation machine is typically several thousand amperes. This current often has an AC component, having been obtained by rectification from an AC source. These 60 Hz current components are usually present everywhere in the formation machine. The use of a very low frequency in voltage source 58 and the use of a low-pass filter in ammeter 60 will avoid reading the 60 Hz currents or harmonics thereof. For this reason it is preferred to employ low frequencies of 10 Hz or less at source 58 to make such filtering less costly. The use of frequencies of below 10 Hz permit even more effective filtering. However, below 0.1 Hz the advantage of greater accuracy realizable by use of the method of this invention begin to reach diminishing returns, at least in connection with the formation methods and equipment in use today. One disadvantage of lower frequencies is that the response time of the system decreases. Sudden changes in the foil capacitance may be smoothed out so that formation irregularities are missed altogether. Thus, considering all factors, the range of frequencies preferred is from 0.5 to 2 Hz.

The level of electrolyte, e.g. 50, will change due to evaporation, due to electrolyte being carried away on the foil as it exits, and due to accumulations of sediment in the tank (e.g. 32) over large periods of time. For optimum accuracy and repeatability of the continuous-oxide-thickness (or capacity)-monitor, it is necessary to use all of the numerous conventional means for maintaining constant the level of electrolyte in the tank 32, FIG. 2 and both tanks 16 and 20 in FIG. 1. A standard combination of pump and weir liquid-level-stabilizing means (not shown) can be used for this purpose.

What is claimed is:

1. A method for continuously monitoring the thickness of the oxide that is formed on an aluminum electrolytic capacitor foil comprising:

(a) drawing an aluminum capacitor foil through first and second liquid electrolytes, said foil being completely covered by an adherent film of aluminum oxide;

(b) connecting a source of AC voltage between a first electrode immersed in said first electrolyte and a second electrode immersed in said second electrolyte;

(c) separating from the current flowing through said AC source, the leading reactive component relative to said AC voltage; and (d) monitoring said reactive current whereby the ratio of said AC voltage to said reactive current is a direct measure of the thickness of said oxide film.

2. The method of claim 1 wherein the frequency of said AC voltage is less than 10 Hz.

3. The method of claim 2 wherein said frequency of said AC source is from 0.5 to 2 Hz.

4. The method of claim 2 additionally comprising filtering out from the electrical current flowing in said AC source, components of 60 Hz.

5. A method for continously monitoring the thickness of the oxide that is being formed on an aluminum electrolytic capacitor foil comprising:

(a) drawing a bare aluminum capacitor foil through a formation machine including an energized formation tank containing a formation electrolyte and continuously forming therein an aluminum oxide film over said foil;

(b) drawing said formed foil through a second electrolyte contained in a second tank, an AC voltage source being connected between a first electrode immersed in said formation electrolyte and a second electrode immersed in said second electrolyte;

(c) separating from the current flowing through said AC source, the leading reactive component relative to said AC voltage; and (d) monitoring said reactive current whereby the ratio of said AC voltage to said reactive current is a direct measure of the thickness of said oxide film.

6. The method of claim 5 wherein the frequency of said AC voltage is less than 10 Hz.

7. The method of claim 5 wherein said AC voltage is less than 0.9 r.m.s. volts.

* * * * *